US008317193B2

(12) United States Patent
Yano

(10) Patent No.: US 8,317,193 B2
(45) Date of Patent: Nov. 27, 2012

(54) SHEET CONVEYING APPARATUS AND IMAGE FORMING APPARATUS

(75) Inventor: Takashi Yano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/161,855

(22) Filed: Jun. 16, 2011

(65) Prior Publication Data

US 2012/0001382 A1 Jan. 5, 2012

(30) Foreign Application Priority Data

Jun. 30, 2010 (JP) ..... 2010-148960
Jun. 10, 2011 (JP) ..... 2011-129709

(51) Int. Cl.
*B65H 7/02* (2006.01)

(52) U.S. Cl. ..... 271/258.01; 271/265.01; 271/176

(58) Field of Classification Search ..... 271/258.01, 271/265.01, 176; 399/18, 21
See application file for complete search history.

(56) References Cited

U.S. PATENT DOCUMENTS 5,615,876 A * 4/1997 Yergenson et al. ..... 271/258.01
5,882,130 A * 3/1999 Kumazaki et al. ..... 400/642
5,923,140 A * 7/1999 Azumi et al. ..... 318/640
5,962,861 A 10/1999 Fowler
6,260,840 B1 7/2001 Suga et al.
6,382,622 B1 5/2002 Takada et al.
6,467,767 B2 10/2002 Yano
6,826,383 B2 11/2004 Yano
6,988,727 B2 1/2006 Yano
7,182,336 B2 * 2/2007 Fukushima et al. ..... 271/265.01
2005/0133992 A1 * 6/2005 Ueng et al. ..... 271/902
2007/0075484 A1 * 4/2007 Terada ..... 271/258.01
2007/0182091 A1 * 8/2007 Kubochi ..... 271/265.01
2010/0061781 A1 * 3/2010 Won ..... 399/367
2010/0276863 A1 11/2010 Yano

FOREIGN PATENT DOCUMENTS

JP 2003-057892 2/2003

* cited by examiner

*Primary Examiner* — David H Bollinger
(74) *Attorney, Agent, or Firm* — Fitzpatrick, Cella, Harper & Scinto

(57) ABSTRACT

A sheet conveying apparatus has a conveying portion which conveys a sheet, a lever which is pushed by the sheet conveyed by the conveying portion, and moves from a standby position, a detecting portion which generates a signal corresponding to a position of the lever, and generates a first signal when the detecting portion detects movement of the lever in a first moving area from the standby position to a predetermined position and generates a second signal when the detecting portion detects movement of the lever in a second moving area beyond the predetermined position, and a biasing portion which does not apply to the lever a biasing force when the lever is in the first moving area, and applies to the lever a biasing force opposite in a direction in which the lever is pushed by the sheet and moves when the lever is in the second moving area.

17 Claims, 14 Drawing Sheets

STANDBY POSITION

*FIG. 2A*
STANDBY POSITION
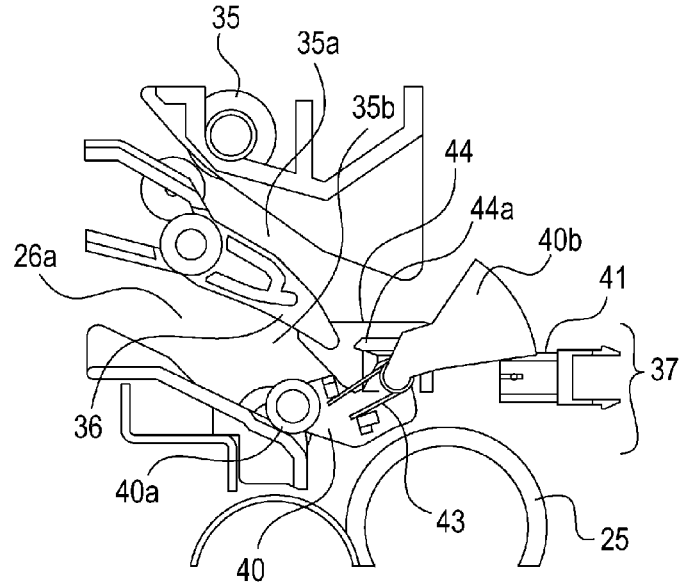
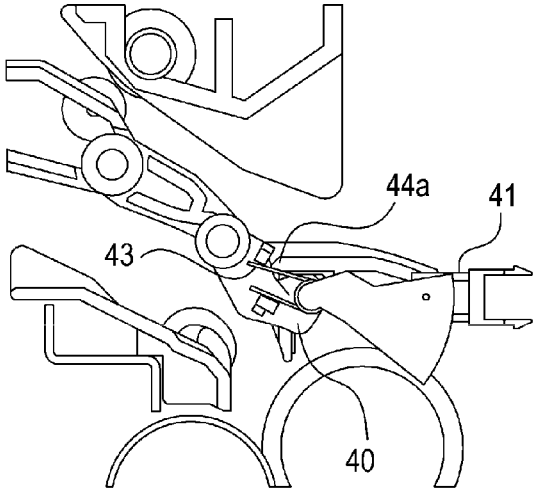
*FIG. 2B*
BOUNDARY POSITION
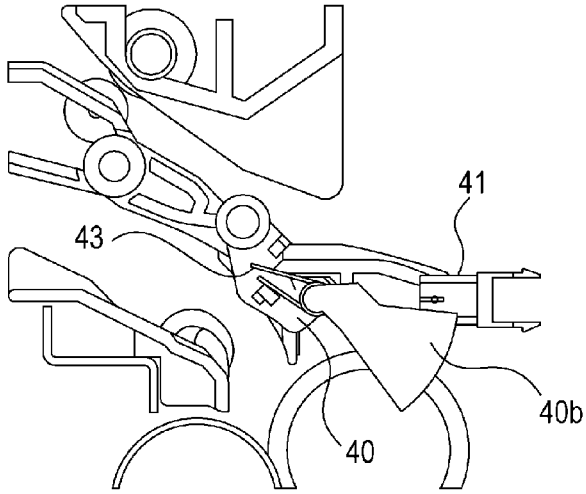
*FIG. 2C*
RETRACTED POSITION

*FIG. 3A*
DETECT SHEET FRONT END
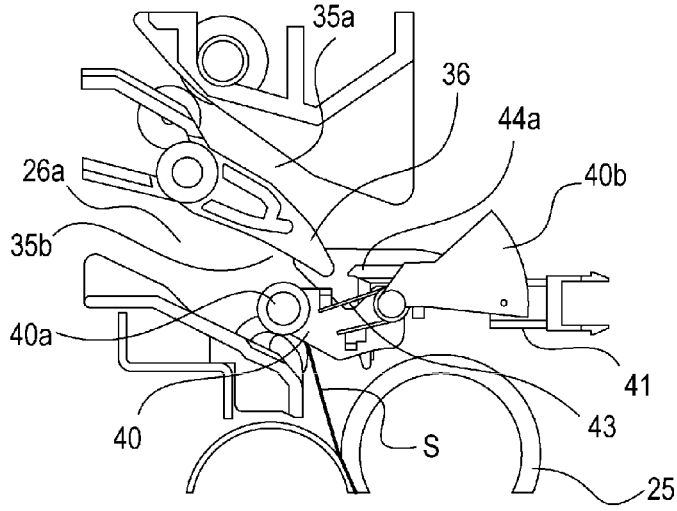
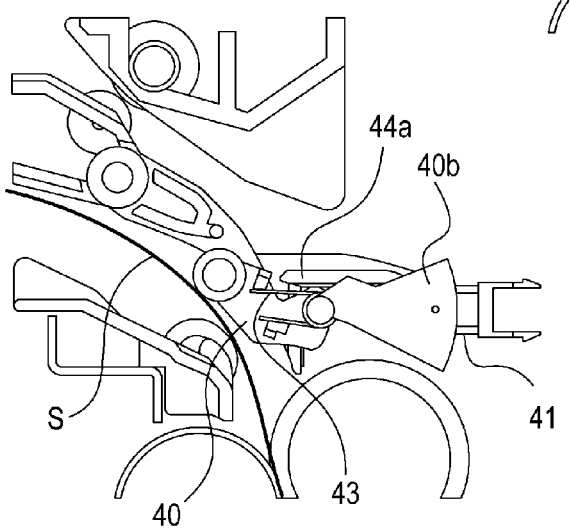
*FIG. 3B*
DURING FEEDING
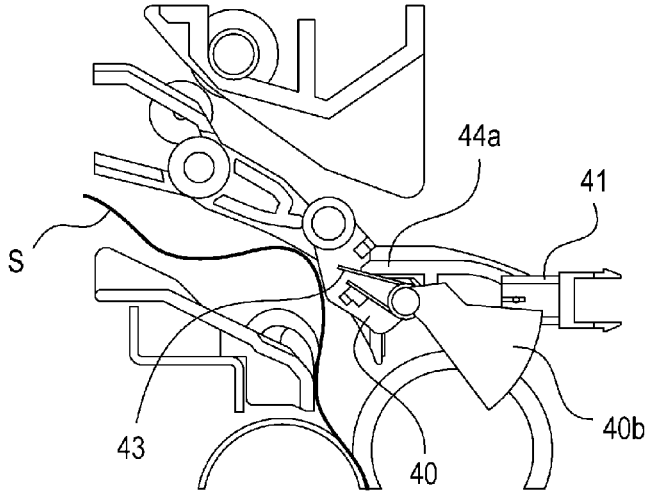
*FIG. 3C*
UPON JAMMING

*FIG. 3D*
DETECT SHEET FRONT END
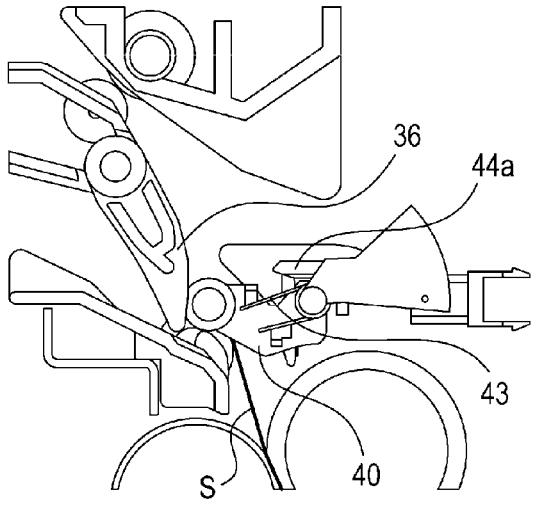
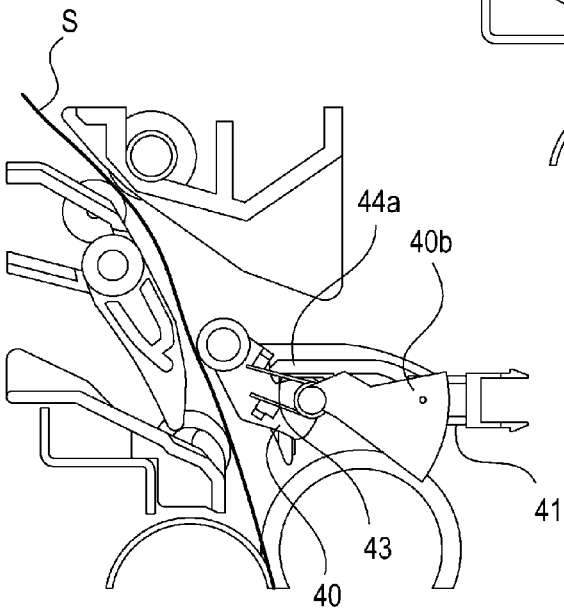
*FIG. 3E*
DURING FEEDING
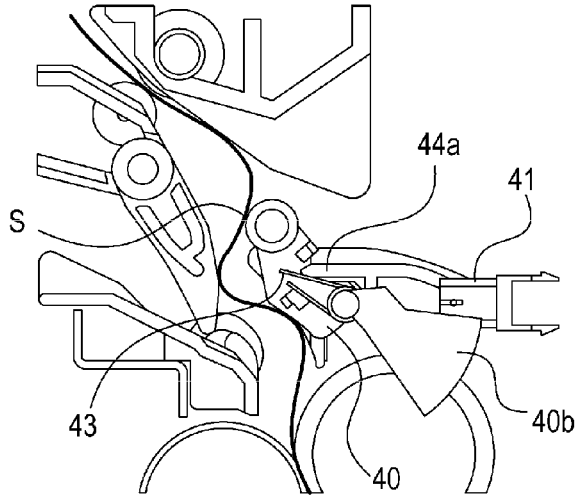
*FIG. 3F*
UPON JAMMING

SENSOR OUTPUT UPON NORMAL CONVEYANCE

SENSOR OUTPUT UPON JAMMING

*FIG. 6A*
STANDBY POSITION
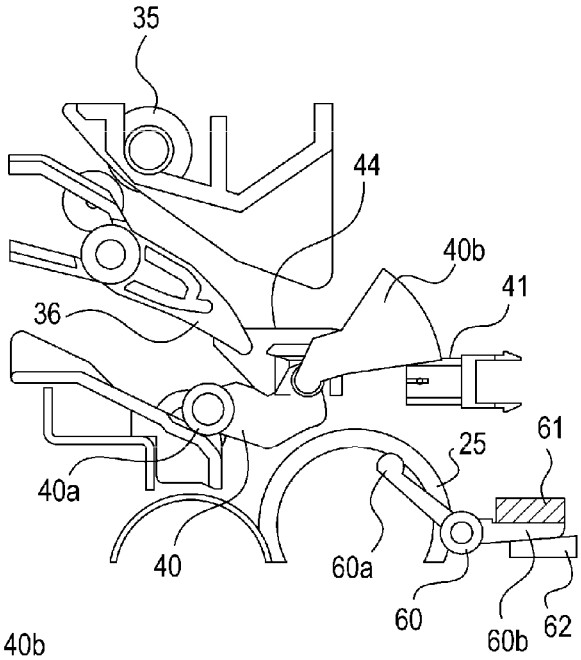
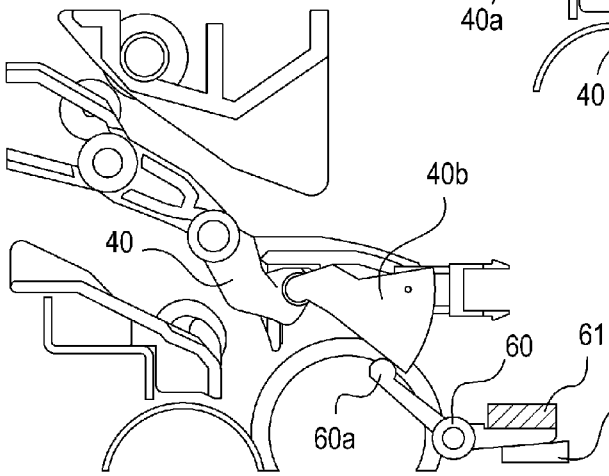
*FIG. 6B*
BOUNDARY POSITION
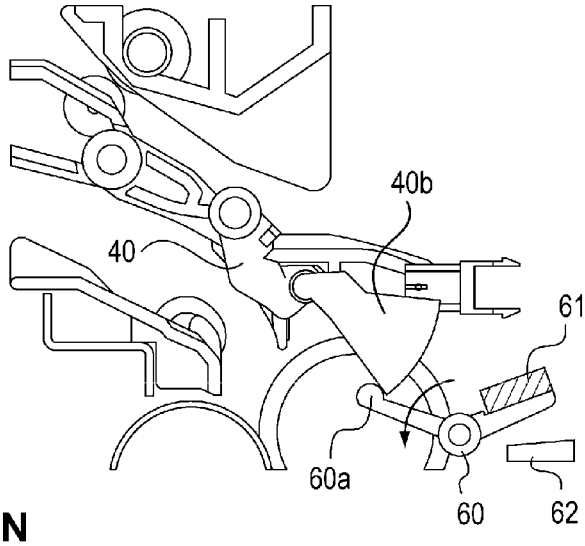
*FIG. 6C*
RETRACTED POSITION

STANDBY POSITION

FIRST BOUNDARY POSITION

SECOND BOUNDARY POSITION

RETRACTED POSITION

DETECT SHEET FRONT END

UPON THIN PAPER

UPON CARDBOARD

UPON SUPER THICK CARDBOARD

SHEET CONVEYING APPARATUS AND IMAGE FORMING APPARATUS

BACKGROUND OF THE INVENTION

1. Field of the Invention

The present invention relates to a sheet conveying apparatus which conveys sheets and an image forming apparatus which has a sheet conveying apparatus.

2. Description of the Related Art

The type of sheet used in recent image forming apparatuses has a wide variety. Further, environment in which an image forming apparatus varies between users, and, with the recent eco-friendly trend, the back faces of sheets which have been used once are more commonly reutilized. Therefore, disturbance factors for conveyance of sheets are significantly increasing. For this reason, it is difficult to completely solve the problem of jamming while sheets are conveyed, and suppressing a jamming incidence as well as how to avoid damages when jamming occurs are becoming more important.

That is, when jamming occurs, it is necessary to safely stop the operation of an image forming apparatus in an easily recoverable state. Typical jamming which may influence a recovery operation from jamming and product performance includes jamming (hereinafter referred to as "accordion jamming") which is caused by forming a multiple-folded accordion shape of a sheet on a conveying path. The factor which causes this accordion jamming includes cases where a sheet front end cannot proceeds smoothly to a conveying roller in a downstream side due to some factors or a sheet front end sticks to, for example, a difference in level of a conveying path. When accordion jamming occurs, there is a problem that a jammed sheet applies a significant stress to adjacent parts such as guides which form the conveying path. Further, the conveying roller which is conveying the jammed sheet continues pushing the sheet until jamming is detected and driving is stopped, and therefore there is a problem that the sheet is caught by the conveying roller. Particularly when the conveying roller is a fixing roller, once the sheet is caught, a toner image on the sheet is melted by heat, and the sheet faces are adhered and placed in a state where it is very difficult to process the jammed sheet.

A technique is known which detects the growth of an excessive loop which leads to jamming of a sheet by monitoring the loop state of a sheet which is being conveyed based on the position of a sensor lever which is pushed by the sheet to be conveyed and rotates (see Japanese Patent Laid-Open No. 2003-057892). The detecting mechanism of Japanese Patent Laid-Open No. 2003-057892 changes an output at two stages according to the rotation amount of the sensor lever. When a sheet is normally conveyed, the sensor lever which is pushed by this sheet and rotates a small angle, and one output of two sensors becomes on. By contrast with this, when the sheet front end is caught by the conveying guide, conveyance is prevented, and a loop grows excessively or when accordion jamming occurs, the sensor lever is pushed by the sheet and rotates greater than the above small angle, and the outputs of two sensors become on.

Further, a technique is known which detects the sheet thickness (sheet strength) according to the position of the sensor lever which is pushed by a sheet to be conveyed and rotates (see U.S. Pat. No. 5,962,861). When a sheet having a normal thickness is conveyed, the sensor lever is pushed by the sheet and rotates a small angle. By contrast with this, when a sheet which is thicker than the normal thickness is conveyed, the sensor lever is pushed by the sheet and rotates greater than the above small angle, so that the sensor detects that the sensor lever significantly rotates. Further, the sheet thickness is recognized based on the output from the sensor.

However, with the conventional technique for obtaining the above information related to sheets (sheet information), the relative relationship between the movement amount of the sensor lever which is pushed by a sheet and a biasing force which applies a force to the sensor lever in a direction in which the sensor lever abuts on the sheet holds a nearly linear relationship in a movable range of the sensor lever, and therefore there is the following problem.

When, for example, the sheet front end proceeds into the conveying roller on the conveying direction downstream side beyond the sensor lever or when the sheet rear end passes the conveying roller on the upstream side beyond the sensor lever, this shock may be transmitted through the sheet face. Accompanying this phenomenon, the sensor lever is repelled by the sheet face, and the sensor lever is pushed by the sheet and significantly rotates even though the loop of the sheet is not actually excessive or the sensor lever is pushed by the sheet and rotates significantly even though the sheet is not thick, thereby causing false detection of sheet information.

Further, even in case where a sheet is curled, the sensor lever is repelled by the sheet front and rear ends when the sheet front and rear ends pass the sensor lever, and significantly rotates, thereby causing false detection of sheet information.

SUMMARY OF THE INVENTION

The present invention provides a sheet conveying apparatus which reduces false detection of sheet information.

To achieve the above object, the sheet conveying apparatus according to the present invention includes a conveying portion which conveys a sheet, a lever which is pushed by the sheet conveyed by the conveying portion, and moves from a standby position, a detecting portion which generates a signal corresponding to a position of the lever, and generates a first signal when the lever moves in a first moving area from the standby position to a predetermined position and generates a second signal when the lever moves in a second moving area beyond the predetermined position, and a biasing portion which does not apply to the lever a biasing force when the lever is in the first moving area, and applies to the lever a biasing force opposite in a direction in which the lever is pushed by the sheet and moves when the lever is in the second moving area.

Further features of the present invention will become apparent from the following description of exemplary embodiments with reference to the attached drawings.

BRIEF DESCRIPTION OF THE DRAWINGS

FIG. 2A is an explanatory view of an operation position (standby position) of a fixing discharge sensor according to the first embodiment;

FIG. 2B is an explanatory view of an operation position (boundary position) of a fixing discharge sensor according to the first embodiment;

FIG. 2C is an explanatory view of an operation position (retracted position) of a fixing discharge sensor according to the first embodiment;

FIG. 3A is an explanatory view of an operation (single face sheet front end detection) of a fixing discharge sensor according to the first embodiment;

FIG. 3B is an explanatory view of an operation (during single face sheet feeding) of a fixing discharge sensor according to the first embodiment;

FIG. 3C is an explanatory view of an operation (upon single face jamming) of a fixing discharge sensor according to the first embodiment;

FIG. 3D is an explanatory view of an operation (double face sheet front end detection) of a fixing discharge sensor according to the first embodiment;

FIG. 3E is an explanatory view of an operation (during duplex feeding) of a fixing discharge sensor according to the first embodiment;

FIG. 3F is an explanatory view of an operation (upon duplex jamming) of a fixing discharge sensor according to the first embodiment;

FIG. 6A is an explanatory view of an operation position (standby position) of a fixing discharge sensor according to a modified embodiment;

FIG. 6B is an explanatory view of an operation position (boundary position) of a fixing discharge sensor according to a modified embodiment;

FIG. 6C is an explanatory view of an operation position (retracted position) of a fixing discharge sensor according to a modified embodiment;

DESCRIPTION OF THE EMBODIMENTS

In the following, embodiments of the present invention will be described in detail as examples with reference to the drawings.

[First Embodiment] A sheet conveying apparatus and an image forming apparatus having this sheet conveying apparatus will be described with reference to FIGS. 1 to 5 and 11.

Figure 11:
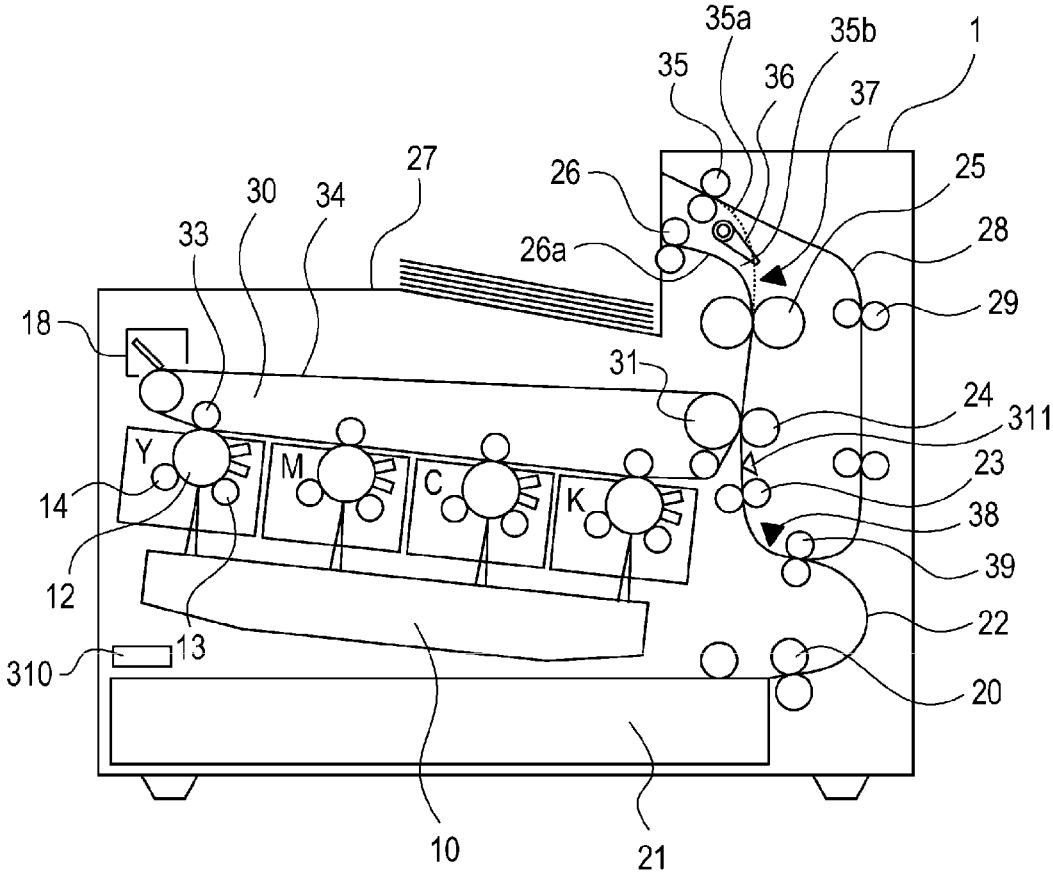
FIG. 11 is a schematic sectional view of an image forming apparatus having the sensor.

First, an image forming apparatus having the sheet conveying apparatus will be described with reference to FIG. 11. FIG. 11 is a schematic sectional view of an image forming apparatus. Hereinafter, an electronic photograph printer will be illustrated as the image forming apparatus.

As shown in FIG. 11, in the upper part of a printer body 1, an image forming portion is arranged which forms a color image on a sheet using toners of yellow, magenta, cyanogen and black (hereinafter abbreviated as "Y", "M", "C" and "K", respectively). The image forming portion includes a photosensitive drum described below which is an image bearing member and a processing portion described below which works on the photosensitive drum.

Print data transmitted from an external device such as a PC is received by a controller 310 which is a controlling portion which controls the printer body 1, and is output to a laser scanner 10 as write image data. The laser scanner 10 irradiates a photosensitive drum 12 of each station of Y, M, C and K with laser, and draws an optical image (latent image) according to write image data. Hereinafter, a configuration is employed in which one laser scanner irradiates all stations of Y, M, C and K with laser.

In the image forming portion, process cartridges (indicated by Y, M, C and K in FIG. 11) which form primary images are detachably attached to meet each station of Y, M, C and K. The process cartridge integrally has the photosensitive drum 12, a charger 13 which is a processing portion which works on the photosensitive drum 12, a development device 14, and a cleaner (not illustrated).

The charger 13 is a charging portion which uniformly charges the surface of the photosensitive drum 12. The development device 14 is a development portion which develops an electrostatic latent image which is created when the laser scanner 10 draws an optical image on the surface of the photosensitive drum 12 charged by the charger 13, to a toner image to be transferred to an intermediate transfer belt 34. The cleaner (not illustrated) is a cleaning portion which removes toner stored on the photosensitive drum 12 after a toner image is transferred.

In the position facing each photosensitive drum 12, a primary transfer roller 33 (primary transfer portion) is arranged which transfers a toner image developed on the surface of each photosensitive drum 12 to superpose on the intermediate transfer belt 34.

The toner image (primary image) transferred to the intermediate transfer belt 34 is transferred onto a sheet by means of a secondary transfer roller 31 which also works as a driving roller of the intermediate transfer belt 34 and a secondary transfer counter roller 24 which faces this secondary transfer roller 31 (secondary transfer portion). Toner stored on the intermediate transfer belt 34 without being transferred onto a sheet in the secondary transfer portion is collected by an intermediate transfer belt cleaner 18.

A feeding portion 20 is positioned at an uppermost stream in the sheet conveying direction and is arranged in a lower part of the printer body 1. Sheets stacked and accommodated on a sheet tray 21 are fed one by one by the feeding portion 20, and conveyed toward the downstream through a conveying roller 39 passing the conveying path 22.

The conveying path 22 has a pair of registration rollers 23 which convey a fed sheet to the image forming portion, and corrects skew feeding of sheets and adjusts a timing to write images in the image forming portion and convey sheets.

On the downstream side of the image forming portion, a fixing roller (fixing portion) 25 which fixes a toner image on a sheet is provided.

In the downstream of the fixing roller 25, a discharge conveying path 26*a* is provided which leads to a discharge roller (discharge portion) 26 which discharges sheets from the printer body 1. The discharge conveying path 26*a* is a first conveying path which guides a sheet on which an image is fixed.

Further, in the downstream of the fixing roller 25, a reversing path 35*a* branched from the discharge conveying path 26*a* is provided. The reversing path 35*a* is a second conveying path which is branched from the discharge conveying path 26*a*, and guides a sheet on which an image is fixed. The reversing path 35*a* has a reversing roller (reverse conveying portion) 35 which reverses the sheet conveying direction upon duplex printing.

To which conveying path a sheet is guided can be selected by switching the position of a reversing flapper (switching member) 36. A sheet in single face printing mode and a sheet on two sides of which images are formed in duplex printing mode are guided to the discharge conveying path 26*a* by the reversing flapper 36, and are discharged to outside the apparatus by the discharge roller 26. The discharged sheet is stacked on the discharge tray 27 provided in the upper part of the printer body 1. By contrast with this, a sheet on one side of which an image is formed in duplex printing mode is guided to the reversing path 35*a* by the reversing flapper 36, then the conveying direction of the sheet is reversed by the reversing roller 35 and is conveyed to a duplex conveying path 28 which returns the sheet again to the image forming portion. The duplex conveying path 28 has a duplex conveying roller (re-feeding portion) 29 which re-feeds a sheet reversed and conveyed by the reversing roller 35, to the image forming portion.

A conveying roller 39 which conveys sheets fed from the feeding portion 20, a pair of registration rollers 23 and the fixing roller 25 form a conveying portion which conveys sheets.

Further, in order to use to control conveyance of sheets, the above printer has a conveying sensor 37 which is a sheet detecting apparatus which detects whether or not there is a sheet to convey. The conveying sensor 37 is provided in the conveying path on a sheet conveying direction downstream side beyond the fixing roller 25 and at an upstream beyond a branching portion 35*b* of the conveying path by the reversing flapper 36. Hereinafter, this conveying sensor 37 will be referred to as "fixing discharge sensor".

Figure 1A:
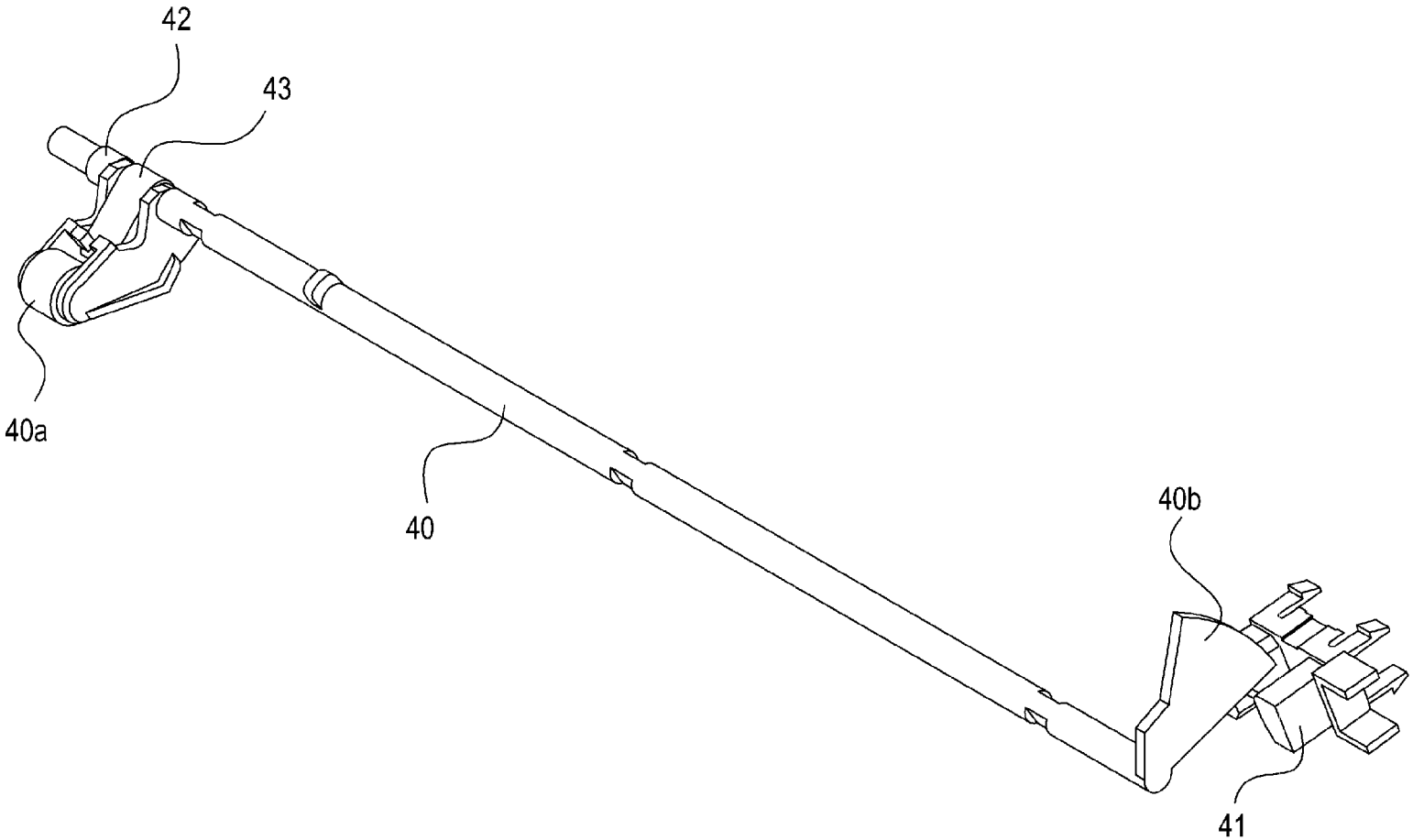
FIG. 1A is a perspective view of a fixing discharge sensor according to a first embodiment.
Figure 1B:
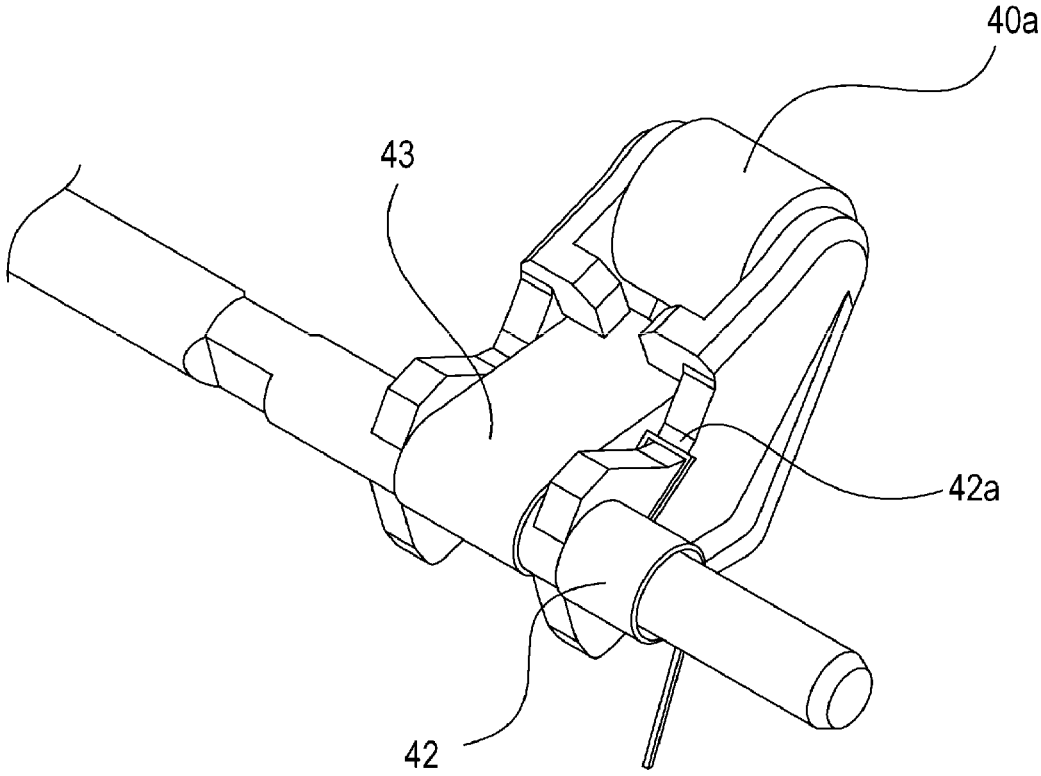
FIG. 1B is a partially enlarged view of a fixing discharge sensor according to the first embodiment.

As illustrated in FIGS. 1A and 1B, the fixing discharge sensor 37 has a sensor lever (moving member) 40 which is pushed by a sheet to be conveyed and moves, and a photo interrupter (detecting portion) 41 which detects the position of the sensor lever 40.

The fixing discharge sensor 37 has two different functions. The first function is to detect timings when front and rear ends of a conveyed sheet pass. The controller 310 of the image forming apparatus detects jamming of sheets due to conveyance delay or detention using this detection information to stop a sheet conveying operation of the image forming apparatus, or determine a timing to switch a rotation direction of the reversing roller 35 upon duplex printing.

The second function is to detect that conveyance of a sheet is disrupted in the downstream of the fixing roller 25 due to some factors and therefore the loop amount of this sheet increases, or that a sheet is folded in an accordion shape. The controller 310 stops the sheet conveying operation of the image forming apparatus using this detection information.

Consequently, according to the present invention, it is possible to improve precision of the second function. Further, it is possible to prevent false detection that the loop is excessive even through the loop is not excessive when the sensor lever of the fixing discharge sensor is pushed by a sheet face in process in which a sheet is guided to the reversing path 35*a* upon duplex printing.

A detailed configuration of the fixing discharge sensor 37 according to the present embodiment will be described with reference to FIGS. 1 to 4. FIGS. 1A and 1B are perspective views of the fixing discharge sensor 37 and FIGS. 2A to 2C are explanatory views of the operation position of the fixing discharge sensor 37. A sensor lever 40 is supported to rock by a guide 44 which is the conveying path in the downstream of the fixing roller 25 at both ends of the sensor lever 40 in the axial direction. The sensor lever 40 is pushed by a sheet to be conveyed, and rotates and moves. An initial biasing spring 42 having one end connected to a spring hook portion 42*b* of the sensor lever 40 and the other end connected to the guide 44 applies a force to the sensor lever 40 in a direction in which the sensor lever 40 abuts on a sheet which is being conveyed. The sensor lever 40 has a sensor flag 40*b* which blocks light for the photo interrupter 41 in addition to a lever portion 40*a* which abuts on a sheet. According the rotation amount of the sensor lever 40, light blocking/non-light blocking state between a light emitting portion and a light receiving portion of the photo interrupter 41 is switched by the sensor flag 40*b*.

In a state where there is no sheet in the fixing discharge sensor portion, light is not blocked between the light emitting portion and light receiving portion (the output of the photo interrupter 41 is an off signal). The position of the sensor lever 40 in this state is "standby position". The sensor lever 40 is applied a force by a gravitational moment which works on the sensor lever 40 and a biasing force of the initial biasing spring 42 in the standby position and is stopped.

Then, when the sensor lever 40 is pushed by a sheet and rotates a first predetermined amount from the standby position, the light emitting portion and light receiving portion of the photo interrupter 41 are placed in the light blocking state (the output of the photo interrupter 41 is an on signal). The position of the sensor lever 40 at this time is referred to as "first detection point".

Then, when the sensor lever 40 is pushed by a sheet and further rotates a second predetermined amount from the first detection point, the light emitting portion and light receiving portion of the photo interrupter 41 are placed again in a transmission state (the output of the photo interrupter 41 is an off signal). The position of the sensor lever 40 at this time is referred to as "second detection point".

Further, in the sensor lever 40, a biasing spring 43 which is a spring unit to form a biasing portion is assembled in a compressed state such that a predetermined pressure is produced. That is, the biasing spring 43 is compressed in a state where both ends are in contact with the sensor lever 40.

The sensor lever 40 is pushed by a sheet and rotates integrally with the biasing spring 43 to a predetermined position from the standby position (see FIG. 2A). Further, when the sensor lever 40 reaches a predetermined position, the biasing spring 43 contacts an engagement portion (abutting portion) 44*a*, which is provided in the guide 44 and which has the fixed position, and applies a load when the sensor lever 40 rotates beyond the predetermined position (see FIG. 2B). Hereinafter, the position of the sensor lever 40 ("predetermined position" described above) when the biasing spring 43 integrally rotates with the sensor lever 40 and contacts the engagement portion 44*a* is "boundary position" which means the boundary between the following first moving area and second moving area.

As long as the lever portion 40*a* of the sensor lever 40 which has reached the boundary position is pushed by a sheet with a force less than elasticity (elastic engaging force) set as the pressure of the biasing spring 43, the biasing spring 43 is in the pressured and compressed state. That is, the biasing spring 43 is not compressed more, and therefore rotation of the sensor lever 40 beyond the boundary position is restricted.

By contrast with this, when the lever portion 40*a* of the sensor lever 40 is pushed by a sheet with a force equal to or more than an elastic engaging force set by the biasing spring 43, the biasing spring 43 is further compressed more than the pressured and compressed state. Therefore, the biasing spring 43 applies an elastic biasing force to the sensor lever 40 in a direction toward the standby position. Further, the sensor lever 40 further rotates beyond the boundary position against this elastic biasing force. In addition, the maximum rotation position where the sensor lever 40 can operate is referred to as "retracted position" (see FIG. 2C).

The above first detection point is set between the standby position and boundary position, and the second detection position is set between the boundary position and retracted position. That is, when moving in an area (first moving area) between the standby position and boundary position (predetermined position), the sensor lever 40 changes the output of the photo interrupter 41. Further, when moving in an area (second moving area) between the boundary position (predetermined position) and retracted position, the sensor lever 40 also changes the output of the photo interrupter 41. That is, the photo interrupter 41 which is the detecting portion generates a signal as a first signal which changes to an on signal when the sensor lever 40 moves on the first detection point in the first moving area. Further, the photo interrupter 41 generates a signal as a second signal which changes to an off signal when the sensor lever 40 moves on the second detection point in the second moving area. Further, when the sensor lever 40 is in the first moving area, the biasing spring 43 does not apply an elastic biasing force to the sensor lever 40 in a direction opposite to the direction in which the sensor lever 40 is pushed by the sheet and moves. When the sensor lever 40 is positioned in the first moving area, the sensor lever 40 is applied a force toward the standby position by a gravitational moment produced by the weight of the sensor lever 40 and a spring force of the initial biasing spring 42. Further, when the sensor lever 40 is in the second moving area, the biasing spring 43 applies a force to the sensor lever 40 in a direction opposite to the direction in which the sensor lever is pushed by a sheet and moves.

Figure 4:
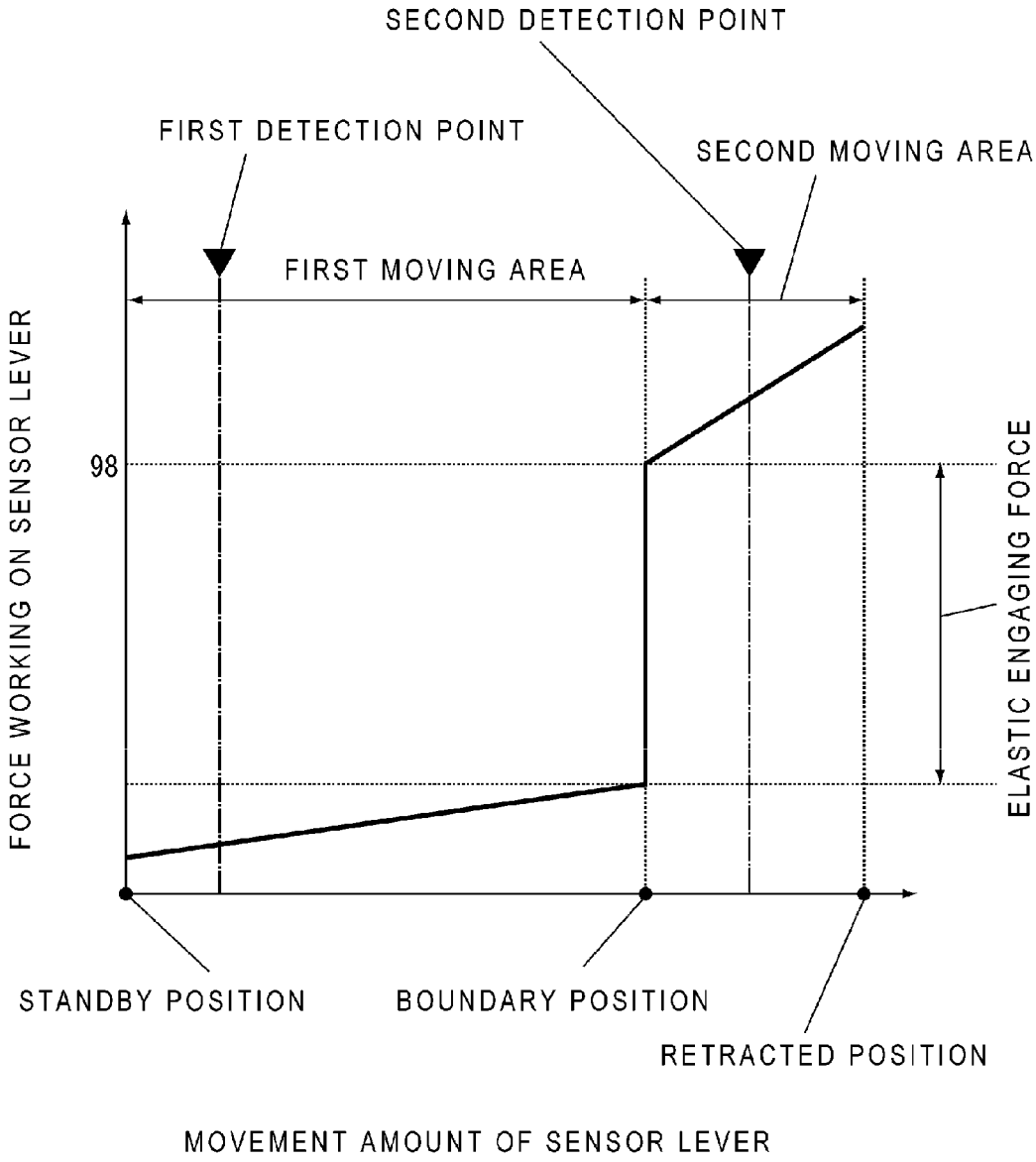
FIG. 4 is a graph illustrating the relationship between a movement amount and a biasing force of a fixing discharge sensor according to the first embodiment.

FIG. 4 illustrates as a graph the relationship between the rotation amount of the above sensor lever 40, gravitational moment produced by the weight of the initial biasing spring 42 and the sensor lever 40, and a biasing force applied to the sensor lever 40 by the biasing spring 43.

Next, an operation of the fixing discharge sensor 37 will be described together with an actual motion of a sheet with reference to FIGS. 3A to 3F. The operation of the fixing discharge sensor 37 when a sheet is conveyed toward the discharge conveying path 26*a* is illustrated in FIGS. 3A to 3C, and the operation of the fixing discharge sensor 37 when a sheet is conveyed toward the reversing path 35*a* is illustrated in FIGS. 3D to 3F.

According to a normal sheet conveying operation, the sensor lever 40 operates between the standby position and boundary position. When a sheet S is conveyed to the fixing discharge sensor portion, the sheet front end pushes the lever portion 40*a* of the sensor lever 40 and the sensor flag 40*b* changes the photo interrupter 41 from the non-light blocking state to the light blocking state, and then the fixing discharge sensor 37 generates a sheet front end detection signal for detecting that the sheet is conveyed (see FIGS. 3A and 3D).

While the sheet is passing this sensor portion, the sensor lever 40 rotates beyond the first detection point and does not yet rotate to the second detection point. At this time, there are some cases where the sensor lever 40 does not reach the boundary position or reaches the boundary position (see FIGS. 3B and 3E). FIG. 3B illustrates the state where a sheet is conveyed pushing the sensor lever 40 in a state where the biasing spring 43 does not abut on the engagement portion 44*a*. FIG. 3E illustrates the state where a sheet is conveyed pushing the sensor lever 40 until the biasing spring 43 contacts with the engagement portion 44*a*.

After the sheet is normally conveyed and passes the sensor portion, the sensor lever 40 (sensor flag 40*b*) returns to the standby position. When the sensor lever 40 returns to this standby position, the photo interrupter 41 changes from the light blocking state to the non-light blocking state, so that the fixing discharge sensor 37 generates a sheet rear end detection signal for detecting a timing when the sheet rear end passes the sensor portion.

In addition, the controller 310 of the image forming apparatus controls a predetermined operation of the image forming apparatus based on the signal from the above fixing discharge sensor 37. In addition, the controller 310 has a ROM and a RAM and receives an input of a signal from the fixing discharge sensor 37. The controller 310 decides jamming such as conveyance delay or detention based on, for example, the signal input from the fixing discharge sensor 37, and stops the conveying operation of the image forming apparatus.

Also, after, for example, a time (normally conveyed sheet detection time) passes when the sheet rear end is expected to pass the fixing discharge sensor 37 in normal conveyance after arrival of the sheet front end is detected based on the signal from the fixing discharge sensor 37, if passing of the sheet rear end is not detected, the controller 310 decides that jamming of a sheet detained in the conveying path Occurs. Then, the controller 310 stops the sheet conveying operation of the image forming apparatus. Further, upon duplex printing, the controller 310 recognizes the position of a sheet rear end to be conveyed, based on the signal from the fixing discharge sensor 37, and controls the sheet conveying operation of the image forming apparatus to switch the rotation direction of the reversing roller 35 according to this recognition.

By contrast with this, when a situation occurs where, for example, conveyance of the sheet S is prevented in the downstream of the fixing discharge sensor 37, the sheet S is fed by the fixing roller 25 from the upstream side, and therefore the loop of the sheet S grows in an area near the fixing discharge sensor. When this loop becomes larger, the sensor lever 40 of the fixing discharge sensor is pushed by a sheet face, then rotates and is finally engaged in the boundary position. When the loop then continues growing or is folded in an accordion shape and the biasing force of the sheet S with respect to the lever portion 40*a* of the sensor lever 40 exceeds the threshold 98 including the elastic engaging force of the biasing spring 43, the sensor lever 40 rotates beyond the boundary position and reaches the second detection point (see FIGS. 3C and 3F). Even before the time reaches the normally conveyed sheet detection time, when the sensor lever 40 rotates beyond this boundary position, the photo interrupter 41 switches to the non-light blocking state, so that the controller 310 detects that a sheet is jammed. Further, when this second type jamming occurs, the controller 310 stops the sheet conveying operation of the image forming apparatus.

In addition, a mode has been described here where, when the sensor lever 40 is positioned in the moving area between the standby position and boundary position, the weight of the sensor lever 40 and spring force of the initial biasing spring 42 work on the sensor lever 40, and the sensor lever 40 is applied a force toward the standby position. However, when the sensor lever 40 is positioned in the moving area between the standby position and boundary position, the sensor lever 40 may be configured to be applied a force toward the standby position only by the weight of the sensor lever 40. It goes without saying that, if this configuration is employed, when the sensor lever 40 is positioned in the moving area between the standby position and boundary position, the spring force of the biasing spring 43 forming the biasing portion does not work on the sensor lever 40, and, when the sensor lever 40 moves beyond the boundary position, the biasing force of the biasing spring 43 is configured to work on the sensor lever 40.

Next, a monitoring method of the controller method 310 for outputs of the fixing discharge sensor 37 will be described in terms of conveyance control of the image forming apparatus.

As described above, a configuration is employed with the present embodiment where detection is performed at two stages of the first detection point and second detection point using on/off of one photo interrupter 41. Hence, to prevent false detection of a sensor output signal, the controller 310 of the image forming apparatus manages a timing to monitor the output of the fixing discharge sensor to decide whether the output is from the first detection point and second detection point.

Figure 5A:
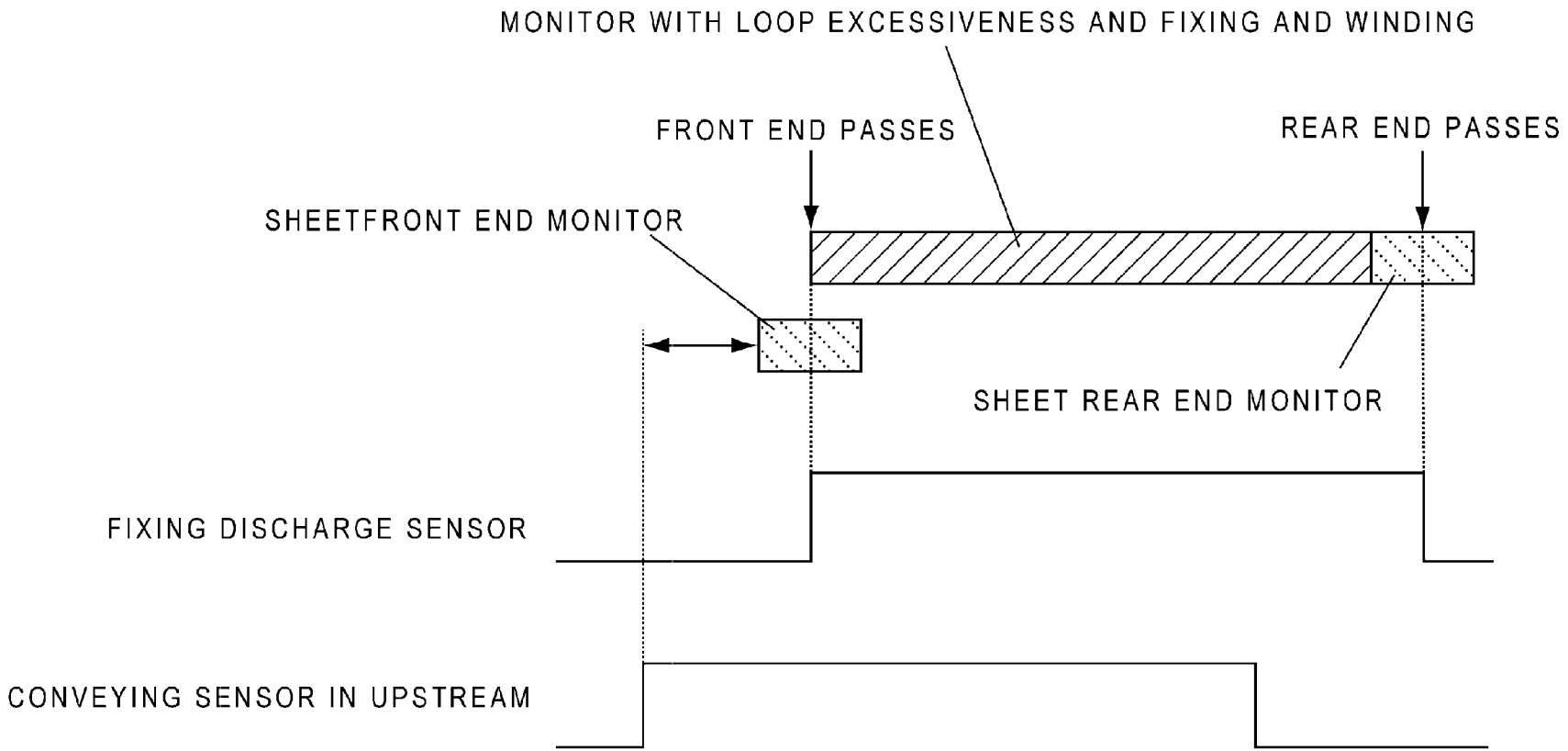
FIG. 5A illustrates an output waveform of a fixing discharge sensor upon normal conveyance according to the first embodiment.
Figure 5B:
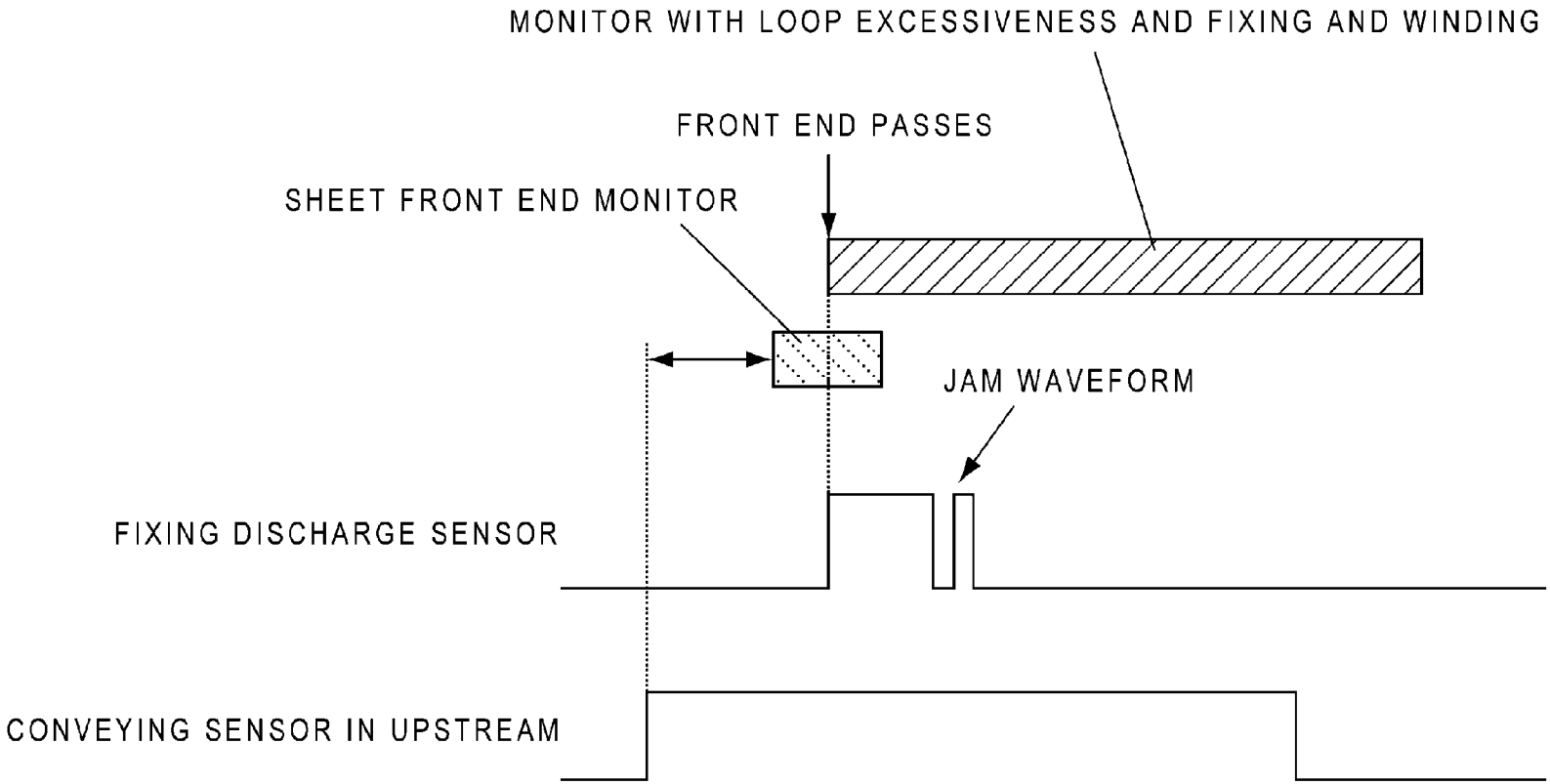
FIG. 5B is a view illustrating an output waveform of a fixing discharge sensor upon jamming according to the first embodiment.

FIGS. 5A and 5B illustrate examples of a sensor output monitor situation in the controller 310 and sensor output waveform. The controller 310 is triggered by an arrival of the sheet to the conveying sensor 311 in the upstream beyond the fixing portion to start monitoring the fixing discharge sensor from the predetermined time. Further, when the output of the fixing discharge sensor 37 switches to on, the controller 310 decides that the sheet front end is detected (first detection point). At the same time, the controller 310 starts simultaneously monitoring the first detection point and second detection point to detect jamming.

When a sheet has an excessive loop or is folded in an accordion shape while it is conveyed, the sensor lever 40 rotates beyond the second detection point as described above, and the output of the fixing discharge sensor becomes off before the normally conveyed sheet detection time.

Also, when the sheet front end reaches the fixing discharge sensor and is wound around the fixing roller (fixing rotating member) while it is conveyed, the sensor lever 40 returns to the standby position before the normally conveyed sheet detection time, and therefore the output of the fixing discharge sensor becomes off. In these cases, the output signal of the fixing discharge sensor is as illustrated in FIG. 5B.

Thus, when the output of the fixing discharge sensor becomes off while whether or not a sheet has a loop excessiveness or is fixed and wound is monitored, the controller 310 broadcasts jamming and stops the image forming operation. In other words, if the output from the fixing discharge sensor becomes off in a time slot when a sheet to be conveyed is supposed to exist in a part facing the fixing discharge sensor, the controller 310 decides that jamming occurs and stops the image forming operation.

In addition, which case of jamming has occurred is not identified here. With the present embodiment, the controller 310 recognizes the length of a sheet which is being fed in the conveying direction, and continues monitoring whether or not the sheet has an excessive loop or is fixed and wound, by a predetermined time (set before 20 mm in terms of a conveying distance) of a theoretical timing when the sheet rear end passes the fixing discharge sensor. That is, until the time passes which is obtained by dividing by a conveying speed a value subtracting 20 mm from the length of the sheet in the conveying direction after the fixing discharge sensor 37 detects the sheet front end, the controller 310 continues monitoring whether the sheet has a loop excessiveness or is fixed and wound. Then, when the controller 310 proceeds to monitoring of sheet rear end detection (first detection point) and the output of the fixing discharge sensor becomes off, the controller 310 decides that the sheet rear end passes the fixing discharge sensor 37. The controller 310 recognizes the length of a sheet which is being fed, based on an input from the operation portion. In addition, a length detecting portion provided on the conveying path may detect the length such that and the controller 310 recognizes the sheet length based on the detection result. In addition, the output signal of the fixing discharge sensor while a sheet is normally conveyed is as illustrated in FIG. 5A.

By the way, the above embodiment has been described where, by taking into account fixing/winding detection, an apparatus is stopped when a short pulse signal in FIG. 5B is off (that is, jamming in FIGS. 3C and 3F occurs before a predetermined passes after the sheet front end is detected and the sensor lever 40 further returns to the standby position). However, by taking into account detection of accordion jamming, the apparatus may be configured to stop according to the first off signal (that is, according to a signal in the state of FIGS. 3C and 3F) before the short pulse signal in FIG. 5B is generated.

According to the present embodiment, the biasing spring 43 engages the sensor lever 40 which is moved by a sheet and moves, in a predetermined position. Therefore, if a force equal to or more than a biasing force (elastic engaging force) of the biasing spring 43 does not work on the sensor lever 40 in a predetermined position, the sensor lever 40 does not move beyond the predetermined position and the output of the photo interrupter 41 does not change. Consequently, it is possible to provide a sheet conveying apparatus which reduces false detection.

By the way, a configuration has been described with the above embodiment where a spring force of the biasing spring 43 is used to engage the sensor lever 40 in the boundary position. However, the present invention is not limited to a configuration which applies an elastic engaging force to the sensor lever in the boundary position using a spring force, and applies an elastic biasing force when the sensor lever rotates beyond the boundary position. Another unit may be used as long as this unit applies a force to the sensor lever which rotates beyond the boundary position. A configuration will be described below as a modified example which applies a force to the sensor lever 40 in the boundary position utilizing the weight of the weight member with reference to FIGS. 6A to 6C.

A load lever 60 having both ends in the axial direction supported to rock in an apparatus frame has an engagement portion 60*a* which can abut on the end of the sensor flag 40*b* and a weighting portion 60*b* to which a weight (weight member) 61 is fixed. When a sheet is not conveyed, the weight of the weight 61 positions the load lever 60 in the standby position where the load lever 60 hits a hitting portion 62 provided in the fixed position (see FIG. 6A). When a sheet is not conveyed, the load lever 60 is separated from the sensor lever 40.

When the sensor lever 40 is rotated from the standby position, the sensor lever 40 finally reaches the boundary position where the sensor flag 40*b* abuts on the engagement portion 60*a* of the load lever 60 (see FIG. 6B). In the boundary position, the force produced by the weight of the weight 61 works on a contact portion between the sensor flag 40*b* and the engagement portion 60*a*. Hence, the force which is added from a sheet to be conveyed to the sensor lever 40 to rotate is equal to or less than the biasing force of the weight of the weight 61, rotation of the sensor lever 40 is restricted between the standby position and boundary position. However, when the force to rotate sensor lever 40 exceeds the biasing force produced by the weight of the weight 61, the sensor flag 40*b* pushes and rotates the load lever 60, so that the sensor lever 40 can rotate to the retracted position beyond the boundary position (see FIG. 6C).

In addition, this modified example differs from the above embodiment in that, while the biasing force is switched using the biasing spring with the above embodiment, the biasing force is switched using the weight 61 of the load lever 60 with the modified example, and other points are the same as the above embodiment. That is, when the photo interrupter detects that the sensor lever 40 rotates beyond the boundary position, the controller 310 recognizes that a sheet forms an excessive loop or is folded in an accordion shape.

In addition, with this modified example, when the sensor lever 40 is moving in the moving area between the standby position and boundary position, the weight of the sensor lever 40 and the biasing force of the initial biasing spring 42 work on the sensor lever 40 and the sensor lever 40 is applied a force toward the standby position. However, a configuration may be employed where, when the sensor lever 40 is moving in the moving area between the standby position and boundary position, the sensor lever 40 is applied a force toward the standby position only by the weight of the sensor lever 40. It goes without saying that, if this configuration is employed, when the sensor lever 40 is moving in the area between the standby position and boundary position, the load lever 60 forming the biasing portion does not work on the sensor lever 40 and, when the sensor lever 40 moves beyond the boundary position, the biasing force of the load lever 60 works on the sensor lever 40.

According to the above embodiment, it is possible to detect an excessive loop for the first time when a force exceeding a predetermined threshold works on the sensor lever. Consequently, it is possible to solve a problem which is likely to occur in a conventional technique that a sensor lever is repelled due to shock when the sheet front and rear ends pass the sensor lever or when the sheet front and rear ends pass a nip of the conveying roller, thereby causing false detection of an excessive loop. Further, before the state of a jammed sheet worsens to an extent that processing is very difficult, it is possible to stop the operation of the image forming apparatus by detecting the likelihood of this state.

Further, according to the present embodiment, there is little limitation as to a place where a sensor lever can be arranged on the conveying path. The conventional technique is susceptible to the influence of the property difference resulting from the type of sheet such as the difference in elasticity of sheets or the curled state of sheet front and rear ends, and therefore has difficulty in arranging the sensor lever in a bent portion of the conveying path where these influences become significant. Further, the conventional technique is susceptible to the influence of the posture of a conveyed sheet, and has difficulty in arranging the sensor lever in a part where the posture of a conveyed sheet changes depending on which conveying path the sheet is conveyed (e.g. the vicinity of the branching portion 35*b* of the conveying path). According to the present embodiment, it is possible to secure a sufficient margin with respect to a problem that the sensor lever unexpectedly moves to a loop excessiveness detection position due to variation of the motion of a sheet which is being conveyed. Consequently, it is possible to arrange the sensor lever in an area such as a bent portion of the conveying path or the vicinity of a path branching point of the duplex reverse portion where, according to the conventional technique, it is difficult to arrange a loop amount detecting sensor due to variation of the motion of sheets. As described above, according to the present invention, there is a reduced risk of false detection and little limitation as to a place where the sensor lever is arranged on the conveying path.

Further, although a configuration has been employed with the present embodiment where one photo interrupter performs detection at two stages of the first detection point and second detection point, the present invention is not limited to this. For example, a configuration may be employed using two of a photo interrupter which changes a signal at the first detection point depending on a sensor lever and another photo interrupter which changes a signal at the second detection point depending on the sensor lever. The two photo interrupters are provided, so that it is possible to identify whether or not the output is from the first detection point or second detection point. Consequently, according to the above embodiment, it is possible to decide whether jamming is caused by a loop excessiveness resulting from detention of sheet conveyance or by a sheet caught in the fixing roller.

Further, according to the present embodiment, it is possible to precisely and stably detect the loop amount of a sheet which is being conveyed, with a very simple configuration. Furthermore, there are a wide variety of application ranges and application methods, and various potentials.

[Second Embodiment] Although the sheet conveying apparatus has been described with the above first embodiment which has a function of detecting the slack sheet state (loop amount), the present invention is not limited to this and is applicable to other functions. An embodiment will be described as one example with reference to FIGS. 7 to 10 where the present invention is applied for use to detect the strength of elasticity of a sheet (sheet basis weight). In addition, the schematic configuration of the image forming apparatus is the same as the configuration according to the first embodiment illustrated in FIG. 11, and therefore the common elements in the second embodiment will be described using the same reference numerals.

According to the present embodiment, a sheet detecting sensor 38 which is the sheet detecting apparatus is provided on a bent conveying path (hereinafter referred to as "bent path") between the registration roller 23 and conveying roller 39 in the upstream of the registration roller 23. The sheet detecting sensor 38 adopts a scheme of detecting the difference in the strength of sheet elasticity and identifying the sheet basis weight. The details will be described below.

Figure 7:
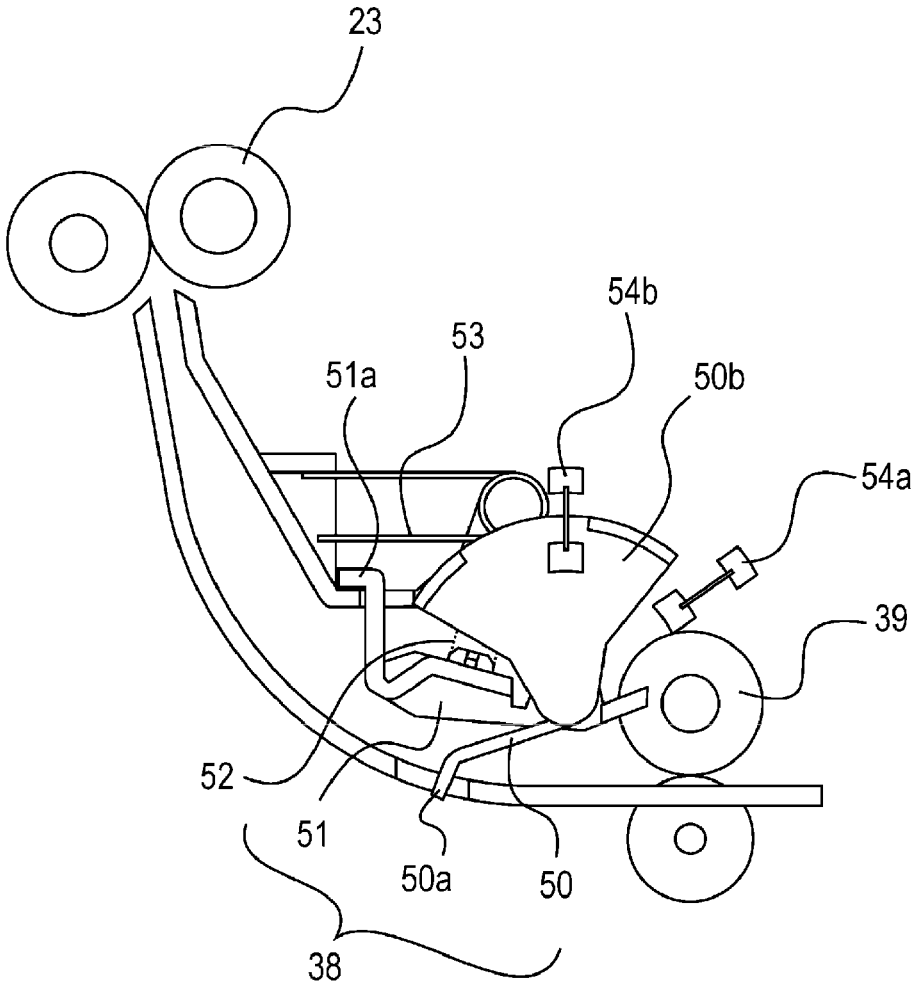
FIG. 7 is a schematic sectional view of the vicinity of a sheet detecting sensor according to a second embodiment.

FIG. 7 is a schematic sectional view of the vicinity of a sheet detecting sensor. FIGS. 8A to 8D are explanatory views of an operation phase of the sheet detecting sensor. The sheet detecting sensor 38 has a sheet detecting lever (moving member) 50 which is pushed by a sheet to be conveyed and moves, and a plurality of photo interrupters (detecting portions) 54*a* and 54*b* which detect the sheet detecting lever 50. Further, the conveying path forms a bent path between the conveying roller 39 and registration roller 23. Inside this bent path, a conveying inner guide 51 supported to rock in the frame of the image forming apparatus is arranged. On the conveying inner guide 51, the sheet detecting lever 50 which has the rotation center near the rocking center of the conveying inner guide is axially supported to rock independently from the conveying inner guide. The sheet detecting lever 50 is axially supported by the conveying inner guide 51 at both ends in the axial direction. The sheet detecting lever 50 is applied a force by the initial biasing force (not illustrated) in a direction in which the sheet detecting lever 50 abuts on a sheet which is being conveyed (direction the sheet detecting lever 50 projects toward the conveying path). The sheet detecting lever 50 can retract to the interior of the conveying inner guide 51 when a lever portion 50*a* is pushed in by a sheet face. The state where this sheet detecting lever 50 projects toward the conveying path is as "standby position" (see FIG. 8A).

Further, a first biasing spring 52 and a second biasing spring 53 are provided near the conveying inner guide 51. The first biasing spring 52 is assembled to apply a pressure between the conveying inner guide 51 and frame of the image forming apparatus body. That is, the first biasing spring 52 is compressed in a state where one end is in contact with the conveying inner guide 51 and the other end is in contact with the frame of the image forming apparatus body. The second biasing spring 53 is assembled in a state where a predetermined pressure is applied toward the frame of the apparatus body facing the conveying inner guide 51. That is, the second biasing spring 53 is compressed in a state where the both ends are in contact with the frame of the image forming apparatus body.

Further, a spring unit including the first biasing spring 52 and conveying inner guide 51 contacts the sheet detecting lever 50 when the sheet detecting lever 50 which is pushed by a sheet and moves to the first position (first boundary position in FIG. 8B) to elastically engage with the sheet detecting lever 50.

The first biasing spring 52 forming a first biasing portion applies an elastic engaging force to the sheet detecting lever 50 in the first boundary position. The first biasing spring 52 applies a first biasing force to the sheet detecting lever 50 when the sheet detecting lever 50 moves beyond the first boundary position. Further, when the sheet detecting lever 50 which is pushed by a sheet with a force equal to or more than the first biasing spring and moves, moves to a second position (second boundary position in FIG. 8C) different from the first position, the second biasing spring 53 contacts with the engagement portion 51b of the conveying inner guide 51 which applies a force to the sheet detecting lever 50, to apply an elastic engaging force to the sheet detecting lever 50. The second biasing spring 53 forming a second biasing portion applies a second biasing force which restricts movement of the sheet detecting lever 50, to the sheet detecting lever 50 when the sheet detecting lever 50 moves beyond the second boundary position.

Figure 8A:
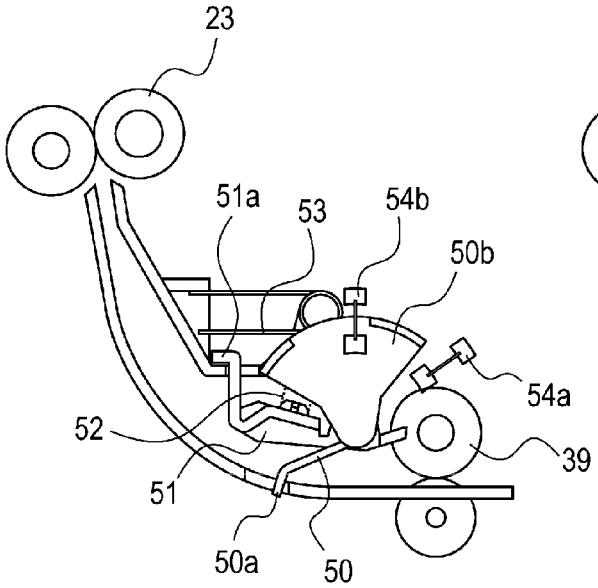
FIG. 8A is an explanatory view of an operation position (standby position) of a sheet detecting sensor according to the second embodiment.
Figure 8B:
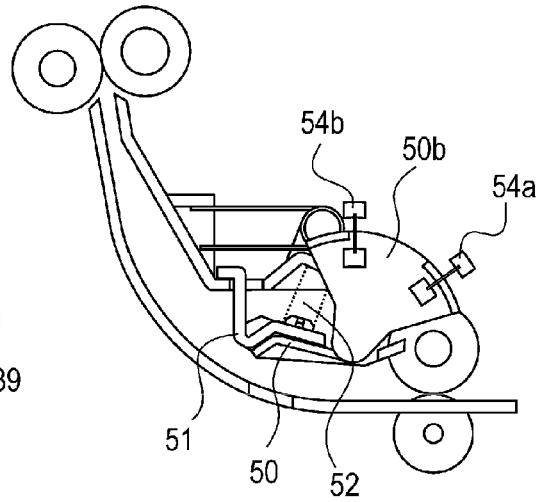
FIG. 8B is an explanatory view of an operation position (first boundary position) of a sheet detecting sensor according to the second embodiment.

The conveying inner guide 51 is assembled in a state where the conveying inner guide 51 is applied a force toward and hits the conveying path side within a movable range by the function of the first biasing spring 52 (see FIGS. 8A and 8B). The position of the sheet detecting lever 50 in a state where the sheet detecting lever 50 hits the conveying inner guide 51 having a posture illustrated in FIG. 8B is "first boundary position".

The pressure of the initial biasing force which applies a force to the sheet detecting lever 50 toward the standby position is set substantially smaller than the pressure of the first biasing spring 52. First, the sheet detecting lever 50 is pushed by the sheet front end, is retracted to the interior of the conveying inner guide 51 and hits the conveying inner guide 51. When the conveying inner guide 51 is further pushed by the sheet detecting lever 50 which is pushed by a sheet face and the force of the sheet detecting lever 50 to push the conveying inner guide 51 exceeds the pressure of the first biasing spring 52, the first biasing spring 52 is compressed and the conveying inner guide 51 rocks in a direction in which the conveying inner guide 51 and the sheet detecting lever 50 retract from the conveying path.

Figure 8C:
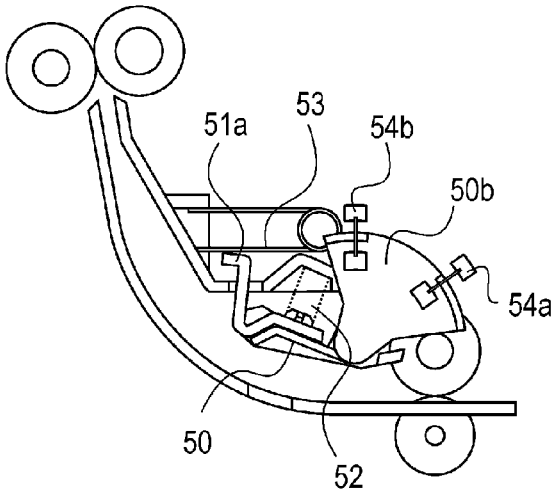
FIG. 8C is an explanatory view of an operation position (second boundary position) of a sheet detecting sensor according to the second embodiment.
Figure 8D:
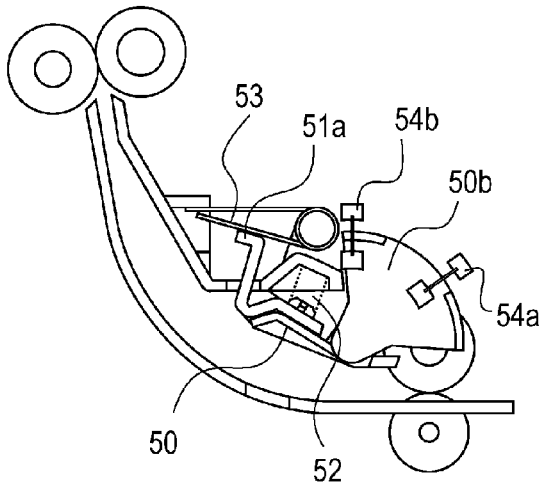
FIG. 8D is an explanatory view of an operation position (retracted position) of a sheet detecting sensor according to the second embodiment.
Figure 9A:
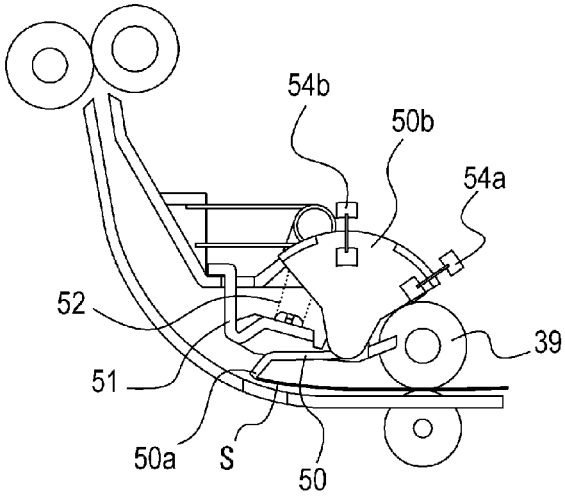
FIG. 9A is an explanatory view of a sheet front end detecting operation of a sheet detecting sensor according to the second embodiment.
Figure 9B:
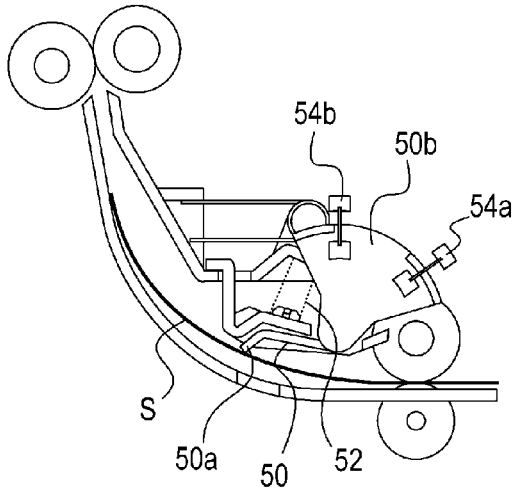
FIG. 9B is an explanatory view of an operation of a sheet detecting sensor upon thin paper according to the second embodiment.
Figure 9C:
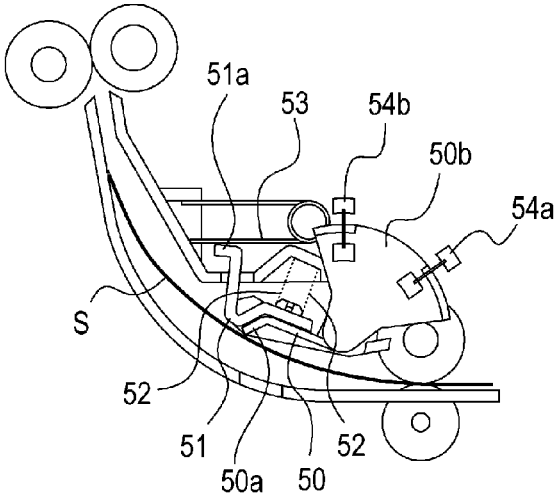
FIG. 9C is an explanatory view of an operation of a sheet detecting sensor upon cardboard according to the second embodiment.
Figure 9D:
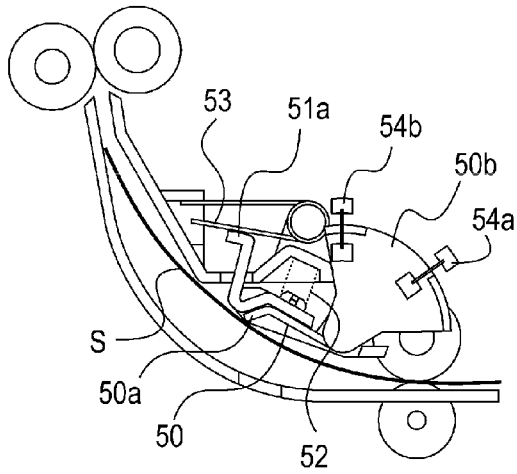
FIG. 9D is an explanatory view of an operation of a sheet detecting sensor upon super thick cardboard according to the second embodiment.

The conveying inner guide 51 is provided with an engagement portion 51*a* in a position facing the second biasing spring 53. When the conveying inner guide 51 is pushed by a force equal to or more than the first biasing force of the first biasing spring 52 and rocks, the engagement portion 51*a* finally abuts on the second biasing spring 53. Further, according to the function of the pressure of the second biasing spring 53, the second biasing spring 53 engages with the conveying inner guide 51 (see FIG. 8C). The state where the sheet detecting lever 50 has a posture illustrated in FIG. 8C is "second boundary position". When an abutting force of the sheet face which presses the conveying inner guide 51 through the sheet detecting lever 50 exceeds a total value of the biasing forces of the first biasing spring 52 and second biasing force 53, the second biasing spring 53 is contracted. By this means, the sheet detecting lever 50 is moved by the sheet and rocks to "retracted position" at the end of the movable area together with the conveying inner guide 51 (see FIG. 8D).

In addition to the lever portion 50*a* which abuts on a sheet, the sheet detecting lever 50 has a sensor flag 50*b* which blocks light for a plurality of photo interrupters (detecting portions) 54*a* and 54*b*. This sheet detecting lever 50 switches light blocking and non-light blocking between the light emitting portions and light receiving portions of the photo interrupters 54*a* and 54*b*. The relationship between the rotation amount of this sheet detecting lever 50 and light blocking/non-light blocking state between the light emitting portions and light receiving portions of the photo interrupters 54*a* and 54*b* is as illustrated in FIGS. 8A to 8D.

More specifically, in a state where there is no sheet in the sheet detecting sensor portion (standby position illustrated in FIG. 8A), the light emitting portion and light receiving portion of the photo interrupter 54*a*, and the light emitting portion and light receiving portion of the photo interrupter 54*b* are placed in the non-light blocking state (the outputs of the photo interrupters 54*a* and 54*b* are off signals). Further, when the sheet detecting lever 50 is pushed by a sheet and rotates a predetermined amount from the standby position, only the light emitting portion and light receiving portion of the first photo interrupter 54*a* changes to the light blocking state (on signal) while the light emitting portion and light receiving portion of the second photo interrupter 54*b* are in the non-light blocking state (off signal). This is defined as "first detection point".

If the force of the sheet pressing the sheet detecting lever 50 is less than the first biasing force of the first biasing spring 52, the sheet detecting lever 50 is engaged by the conveying inner guide 51 and its movement is restricted by the biasing force of the first biasing spring 52. When the force of the sheet pressing this sheet detecting lever 50 is equal to or more than the first biasing force of the first biasing spring 52, restriction of movement by the biasing force of the first biasing spring 52 is canceled, and the sheet detecting lever 50 is pushed by the sheet and rotates. Thus, when the sheet detecting lever 50 is pushed by the sheet and further rotates a predetermined amount from the first boundary position, both of the light emitting portion and light receiving portion of the first photo interrupter 54*a*, and the light emitting portion and light receiving portion of the second photo interrupter 54*b*are placed in the light blocking state (on signal). This is defined as "second detection point".

When the force of a sheet to press the sheet detecting lever 50 is less than the first biasing force of the first biasing spring 52 and the second biasing force of the second biasing spring 53, the engagement portion 51*a* of the conveying inner guide 51 is engaged by the second biasing spring 53 and movement of the sheet detecting lever 50 is restricted by the biasing force of the second biasing spring 53. When the force of a sheet to press this sheet detecting lever 50 is equal to or more than the first biasing force of the first biasing spring 52 and second biasing force of the second biasing spring 53, restriction of movement by the biasing forces of the first biasing spring 52 and second biasing spring 53 is canceled, and the sheet detecting lever 50 is pushed by the sheet and further rotates. Thus, when the sheet detecting lever 50 is pushed by a sheet and further rotates from the second boundary position, only the light emitting portion and light emitting portion of the first photo interrupter 54*a* change to the non-light blocking state (off signal) while the light emitting portion and light receiving portion of the second photo interrupter 54*b* are in the light blocking state (on signal). This is defined as "third detection point". Further, the sheet detecting lever 50 and conveying inner guide 51 are pushed by the pressing force of a sheet equal to or more than the biasing forces of the first biasing spring 52 and second biasing spring, and reaches the retracted position illustrated in FIG. 8D.

Figure 10:
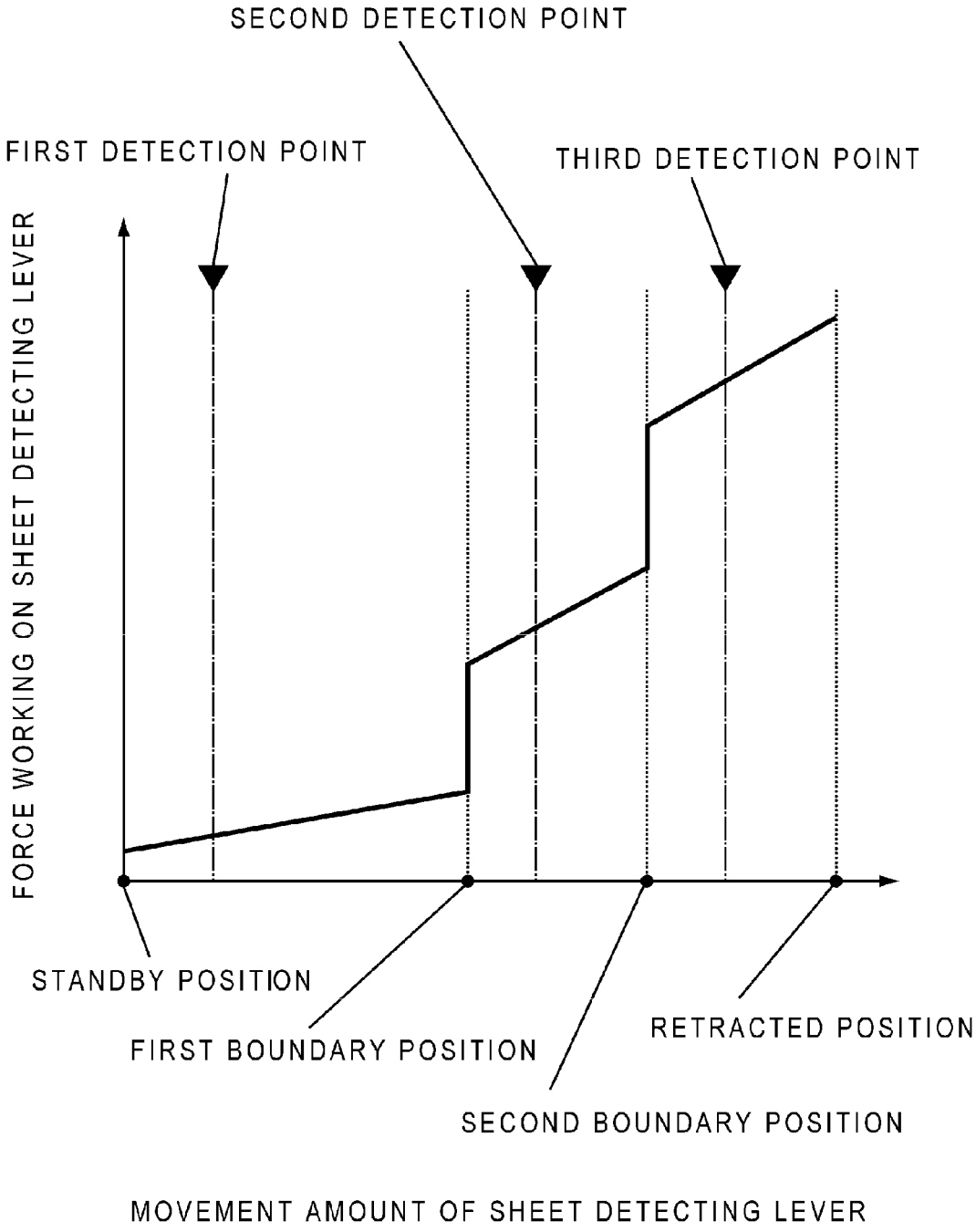
FIG. 10 is a graph illustrating the relationship between a movement amount and a biasing force of a sheet detecting sensor according to the second embodiment.

Thus, by providing a plurality of boundary positions and a plurality of detection points, it is possible to detect a sheet more stepwise compared to the above embodiment. Specifically, a sensor output changes at three stages as described above. The relative positions of the detection points hold the relationship of standby position->first detection point->first boundary position->second detection point->second boundary position->third detection point->retracted position. FIG. 10 illustrates the correlation between the positions and the relationship between the movement amount of the sheet detecting lever and biasing force.

Next, an operation of the sheet detecting sensor 38 while a sheet is conveyed will be described with reference to FIGS. 9A to 9D. The front end of the sheet S conveyed by the conveying roller 39 first rotates the sheet detecting lever 50 to the position beyond the first detection point. The detection timing of the first detection point is used at a later stage of conveyance to control to what extent a loop is formed in the sheet S when skew feeding is corrected by having the sheet front end hit the registration roller 23 which is stopped. In addition, conveyance control for the loop of a sheet is not essential to the present invention, and therefore will not be described.

When the sheet front end enters the bent path before the registration roller, the sheet S contacts the sheet detecting lever 50 and conveying inner guide 51 which are in the inner side of the conveying path according to function of the rigidity of the sheet S. The maximum value of the force of sheet face applied to the sheet detecting lever 50 and conveying inner guide 51 until the sheet front end arrives at the registration roller 23 depends on the strength of the sheet elasticity (basis weight). When the basis weight of the sheet S corresponds to less elastic thin paper and plain paper less than 100 g/m$^2$, the force of the sheet S to abut on the sheet detecting lever 50 and conveying inner guide 51 is less than the force to engage the conveying inner guide 51 with the first boundary position. Therefore, only a detection output of the first detection point can be obtained until the sheet front end arrives at the registration roller 23. By contrast with this, when the basis weight of the sheet S corresponds to cardboard of about 100 to 180 g/m$^2$, each spring force is adjusted such that the force of the sheet S to abut on the sheet detecting lever 50 and conveying inner guide 51 is greater than the elastic force (elastic engaging force) in the first boundary position) and less than the elastic force (elastic engaging force) in the second boundary position. Consequently, a detection output of the second detection point can be obtained until the sheet front end arrives at the registration roller 23. Further, when the basis weight of the sheet S corresponds to super thick cardboard exceeding 180 g/m$^2$, the force of the sheet S to abut on the sheet detecting lever 50 and conveying inner guide 51 is set greater than the elastic force (elastic engaging force) of the second detection point. Consequently, a detection output of the third detection point can be acquired until the sheet front end arrives at the registration roller 23. The controller 310 of the image forming apparatus is triggered when the sheet detecting lever 50 detects the sheet front end, to continue monitoring the output of the sheet detecting sensor 38 by a scheduled time when the sheet front end arrives at the registration roller 23. Further, based on which output of the first detection point, second detection point and third detection point is obtained, the controller 310 of the image forming apparatus decides the basis weight of a sheet which is being conveyed.

Similar to the above embodiment, according to the present embodiment, the engaging springs 52 and 53 engage the sheet detecting lever 50 which is pushed by a sheet and moves, and the conveying inner guide 51 in predetermined positions. Therefore, as long as the force equal to or more than the biasing forces (engaging forces) of the engaging springs 52 and 53 does not work on the sheet detecting lever 50 and conveying inner guide 51 in the predetermined position, the sheet detecting lever 50 and conveying inner guide 51 do not move beyond the predetermined positions, and outputs of the photo interrupters 54*a* and 54*b* do not change. Consequently, it is possible to provide a sheet conveying apparatus which reduces false detection.

In addition, the second embodiment has been described where arrival of the sheet front end is detected and sheet basis weight is detected. However, using the same configuration as the sheet detecting lever 50 and conveying inner guide 51 described in the second embodiment, a configuration may be employed which detects arrival of a sheet as in the first embodiment and failure of the loop excessiveness. That is, arrival of a sheet is detected according to a signal from a photo interrupter an output of which is changed by the sheet detecting lever 50 which is moving between the standby position and first boundary position. Further, the spring force of the first engaging spring 52 and arrangement of the sheet detecting lever 50 are set to detect a loop excessiveness according to a signal of a photo interrupter an output of which is changed by the sheet detecting lever 50 which is moving beyond the first boundary position against the biasing force of the first engaging spring 52.

Further, the biasing forces of the sheet detecting lever 50 and conveying inner guide 51 are configured to switch stepwise in the middle of the movable range of the sheet detecting lever 50 and conveying inner guide 51, so that the sheet detecting sensor 38 can function as a force sensor. By using this function, it is possible to detect the strength of the elasticity of a sheet which is being conveyed and decide the type of sheet (sheet basis weight) as described above.

Further, according to the present embodiment, it is possible to precisely and stably detect the basis weight of a sheet which is being conveyed, with a very simple configuration. Furthermore, there are a wide variety of application ranges and application methods, and various potentials.

[Other Embodiment] Although configurations have been described with the above embodiments where one photo interrupter is used with the first embodiment and two photo interrupters are used with the second embodiment, the number of photo interrupters is not limited to this. Similarly, although one boundary position using the first biasing spring has been described with the first embodiment and two boundary positions using the two biasing springs have been described with the second embodiment, the number of biasing springs (biasing portions) for use and the number of boundary positions are not limited to these. These may be adequately set where necessary.

Further, although a configuration has been described with the above embodiments where the present invention is applied to the conveying sensor in the branching portion 35*b* of the conveying path in the downstream of the fixing roller or to the conveying sensor in the bent conveying path, the present invention is not limited to this. The present invention is also applicable as a conveying sensor at any place in the conveying path.

Further, although the photo interrupter has been described as the detecting portion with the above embodiments, the present invention is not restricted by the type of the detecting portion. For example, the photo interrupter may be substituted with other detecting portion such as a variable resistance, contact switch and reflecting optical sensor.

Further, although the image forming apparatus has been described with the above embodiments which have four image forming stations (Y, M, C and K) of different colors, the colors and number are not limited to these and may be adequately set where necessary.

Further, although the laser scanner has been used as an exposure portion with the above embodiments, the exposure portion is not limited to this and, for example, an LED array may be used.

Further, as a process cartridge which is detachably attached to the image forming apparatus body, a process cartridge has been described with the above embodiments which integrally has the photosensitive drum, charging portion which is a processing portion which works on the photosensitive drum, development portion, and cleaning portion. However, the process cartridge is not limited to this. A process cartridge which integrally has one of a charging portion, development portion and cleaning portion in addition to the photosensitive drum may be used.

Further, although a printer has been described as the image forming apparatus with the above embodiments, the present invention is not limited to this. Other image forming apparatuses such as copying machines or facsimile apparatuses or other image forming apparatuses such as all-in-one machines which have the combined functions of copying machines or facsimile apparatuses may be used. The same effect can be obtained by applying the present invention to the sheet detecting apparatuses in these image forming apparatuses.

Further, although the sheet conveying apparatus has been described with the above embodiments in which integrally have the image forming apparatus, the present invention is not limited to this. For example, the sheet conveying apparatus may be included in the sheet processing apparatus which is detachably attached to the image forming apparatus, and the same effect can be obtained by applying the present invention to this sheet conveying apparatus.

Further, although the sheet detecting apparatus has been described with the above embodiments in which the detecting portion is provided in the conveying path which conveys sheets such as recording paper which is a recording target, the present invention is not limited to this. For example, the same effect can be obtained by applying sheets such as document which is the target to read, to the sheet conveying apparatus.

According to the present embodiment, the biasing portion engages the moving member which is pushed by a sheet and moves, in the predetermined position. Consequently, as long as the force equal to or more than the biasing force (engaging force) of the biasing portion does not work on the moving member, the moving member does not move beyond the predetermined position. Consequently, it is possible to provide a sheet conveying apparatus which reduces false detection.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-148960, filed Jun. 30, 2010, and No. 2011-129709, filed Jun. 10, 2011, which are hereby incorporated by reference herein in their entirety.

What is claimed is:

1. A sheet conveying apparatus comprising:

a conveying portion which conveys a sheet;

a lever which is pushed by the sheet conveyed by the conveying portion, and moves from a standby position;

a detecting portion which detects movement of the lever, and generates a first signal in a case where the detecting portion detects the lever moves in a first moving area from the standby position to a predetermined position, and generates a second signal in a case where the detecting portion detects the lever moves in a second moving area beyond the predetermined position; and a biasing portion which does not apply to the lever a biasing force when the lever is in the first moving area, and applies to the lever a biasing force opposite in a direction in which the lever is pushed by the sheet and moves when the lever is in the second moving area.

2. The sheet conveying apparatus according to claim 1, wherein the biasing portion includes a spring unit which applies a spring force to the lever as the biasing force.

3. The sheet conveying apparatus according to claim 2, further comprising an engagement portion which restricts movement of the spring unit, wherein the spring unit is attached to the lever, and when the lever moves to the predetermined position from the standby position, the spring unit abuts on the engagement portion, and the spring force of the spring unit is applied to the lever.

4. The sheet conveying apparatus according to claim 2, wherein, when the lever moves to the predetermined position from the standby position, the lever abuts on the spring unit, and the spring force of the spring unit is applied to the lever.

5. The sheet conveying apparatus according to claim 1, wherein the biasing portion includes a movable weight member, and when the lever moves to the predetermined position from the standby position, the lever abuts on the weight member, and gravity of the weight member works on the lever.

6. The sheet conveying apparatus according to claim 1, further comprising a controlling portion which stops a conveying operation of the conveying portion when the first signal continues for a predetermined time or more, and stops the conveying operation of the conveying portion when the second signal is generated before the predetermined passes after the first signal is generated.

7. The sheet conveying apparatus according to claim 1, further comprising a controlling portion which detects a type of the sheet to be conveyed, based on a signal from the detecting portion.

8. The sheet conveying apparatus according to claim 1, further comprising:

a first conveying path which guides the sheet; and a second conveying path which is branched from the conveying path, wherein the lever is provided in a branching portion between the first conveying path and the second conveying path, and is pushed by the sheet guided by the first conveying path and the sheet guided by the second conveying path and moves.

9. An image forming apparatus comprising:

a conveying portion which conveys a sheet;

an image forming portion which forms an image on the sheet conveyed by the conveying portion;

a lever which is pushed by the sheet conveyed by the conveying portion, and moves from a standby position;

a detecting portion which detects a movement of the lever, and generates a first signal in a case where the detecting portion detects the lever moves in a first moving area from the standby position to a predetermined position and generates a second signal in a case where the detecting portion detects the lever moves in a second moving area beyond the predetermined position; and a biasing portion which does not apply to the lever a biasing force when the lever is in the first moving area, and applies to the lever a biasing force opposite in a direction in which the lever is pushed by the sheet and moves when the lever is in the second moving area.

10. The image forming apparatus according to claim 9, wherein the biasing portion includes a spring unit which applies a spring force to the lever as the biasing force.

11. The image forming apparatus according to claim 10, further comprising an engagement portion which restricts movement of the spring unit, wherein the spring unit is attached to the lever, and when the lever moves to the predetermined position from the standby position, the spring unit abuts on the engagement portion, and the spring force of the spring unit is applied to the lever.

12. The image forming apparatus according to claim 10, wherein, when the lever moves to the predetermined position from the standby position, the lever abuts on the spring unit, and the spring force of the spring unit is applied to the lever.

13. The image forming apparatus according to claim 10, further comprising a controlling portion which detects a type of the sheet to be conveyed, based on a signal from the detecting portion.

14. The image forming apparatus according to claim 9, wherein the biasing portion includes a movable weight member, and when the lever moves to the predetermined position from the standby position, thelever abuts on the weight member, and gravity of the weight member works on the lever.

15. The image forming apparatus according to claim 9, further comprising a controlling portion which stops a conveying operation of the conveying portion when the first signal continues for a predetermined time or more, and stops the conveying operation of the conveying portion when the second signal is generated before the predetermined passes after the first signal is generated.

16. The image forming apparatus according to claim 15, wherein the conveying portion comprises a fixing portion which fixes on the sheet an image formed by an image forming portion, and the lever is provided in a downstream in a conveying direction beyond the fixing portion.

17. The image forming apparatus according to claim 9, further comprising:

a first conveying path which guides to a discharge portion a sheet on which an image is fixed; and a second conveying path which is branched from the first conveying path, and which guides the sheet on which the image is fixed to a reverse conveying portion which reverses and conveys the sheet, wherein the lever is provided in a branching portion between the first conveying path and the second conveying path, and the lever is pushed by the sheet guided by the first conveying path and the sheet guided by the second conveying path and moves.

* * * * *